US009434906B2

(12) United States Patent
Jukes et al.

(10) Patent No.: US 9,434,906 B2
(45) Date of Patent: Sep. 6, 2016

(54) MARINE DIESEL ENGINE LUBRICATING OIL COMPOSITIONS

(71) Applicants: Ronald Theodorus Fake Jukes, Rotterdam (NL); Eugene E. Spala, Fairfield, CA (US)

(72) Inventors: Ronald Theodorus Fake Jukes, Rotterdam (NL); Eugene E. Spala, Fairfield, CA (US)

(73) Assignees: Chevron Oronite Company, LLC, San Ramon, CA (US); Chevron Oronite Technology B.V., Rotterclam (NL)

( * ) Notice: Subject to any disclaimer, the term of this patent is extended or adjusted under 35 U.S.C. 154(b) by 365 days.

(21) Appl. No.: 13/849,884

(22) Filed: Mar. 25, 2013

(65) Prior Publication Data

US 2014/0287969 A1 Sep. 25, 2014

(51) Int. Cl.
*C10M 159/22* (2006.01)
*C10M 169/04* (2006.01)

(52) U.S. Cl.
CPC ..... *C10M 169/044* (2013.01); *C10M 159/22* (2013.01); *C10M 2203/1006* (2013.01); *C10M 2207/262* (2013.01); *C10M 2219/046* (2013.01); *C10M 2219/089* (2013.01); *C10N 2210/02* (2013.01); *C10N 2220/022* (2013.01); *C10N 2230/02* (2013.01); *C10N 2230/04* (2013.01); *C10N 2230/10* (2013.01); *C10N 2230/52* (2013.01); *C10N 2240/102* (2013.01); *C10N 2260/10* (2013.01); *C10N 2270/00* (2013.01)

(58) Field of Classification Search
CPC ..... C10M 135/10; C10M 141/02; C10M 129/10; C10M 129/26; C10M 129/91; C10M 2207/023; C10M 2207/028; C10M 2207/14; C10M 2207/262; C10M 2219/044; C10M 2219/046; C10M 169/044; C10M 159/22; C10M 2203/1006; C10M 2219/089; C10N 2240/102; C10N 2240/103; C10N 2230/52; C10N 2230/04; C10N 2260/10; C10N 2210/02; C10N 2220/022; C10N 2270/00; C10N 2230/02; C10N 2230/10
See application file for complete search history.

(56) References Cited

U.S. PATENT DOCUMENTS

| | | | | |
|---|---|---|---|---|
| 2,680,096 | A | 6/1954 | Walker et al. | |
| 3,036,003 | A | 5/1962 | Verdol | |
| 3,172,892 | A | 3/1965 | Reed | |
| 3,178,368 | A | 4/1965 | Hanneman | |
| 3,219,666 | A | 11/1965 | Norman et al. | |
| 3,272,746 | A | 9/1966 | Suer et al. | |
| 3,275,554 | A | 9/1966 | Wagenaar | |
| 3,329,658 | A | 7/1967 | Fields | |
| 3,438,757 | A | 4/1969 | Honnen et al. | |
| 3,449,250 | A | 6/1969 | Fields | |
| 3,454,555 | A | 7/1969 | Van Der Voort et al. | |
| 3,565,804 | A | 2/1971 | Honnen et al. | |
| 3,586,629 | A | 6/1971 | Otto et al. | |
| 3,591,598 | A | 7/1971 | Traise et al. | |
| 3,666,730 | A | 5/1972 | Coleman | |
| 3,801,507 | A | 4/1974 | Yus et al. | |
| 3,980,569 | A | 9/1976 | Pindar et al. | |
| 4,234,435 | A | 11/1980 | Meinhardt et al. | |
| 4,612,132 | A | 9/1986 | Wollenberg et al. | |
| 4,744,921 | A | 5/1988 | Liston | |
| 4,746,446 | A | 5/1988 | Wollenberg et al. | |
| 5,024,773 | A | 6/1991 | Liston | |
| 5,318,710 | A | 6/1994 | Campbell | |
| 5,320,762 | A | 6/1994 | Campbell | |
| 5,320,763 | A | 6/1994 | Campbell | |
| 5,529,705 | A * | 6/1996 | Small et al. | 508/287 |
| 6,165,235 | A | 12/2000 | Kolp et al. | |
| 6,372,696 | B1 | 4/2002 | Tipton | |
| 6,440,905 | B1 | 8/2002 | Epps et al. | |
| 6,479,440 | B1 * | 11/2002 | Le Coent | 508/398 |
| 2004/0235686 | A1 | 11/2004 | Boons et al. | |
| 2007/0027043 | A1 | 2/2007 | Le Coent | |
| 2011/0124539 | A1 | 5/2011 | Sinquin et al. | |

FOREIGN PATENT DOCUMENTS

| | | |
|---|---|---|
| EP | 1 126 010 A1 | 8/2001 |
| EP | 1 486 556 A1 | 12/2004 |

OTHER PUBLICATIONS

Molter "Chemistry and Technology of Lubricants", Blackie Academic & Prof sional. 2nd Edition. pp. 287-305 (1997).

* cited by examiner

*Primary Examiner* — Taiwo Oladapo
(74) *Attorney, Agent, or Firm* — M. Carmen & Associates, PLLC

(57) ABSTRACT

Disclosed herein are marine diesel engine lubricating oil compositions which comprises (a) a major amount of an oil of lubricating viscosity, and (b) about 3 wt. % to about 40 wt. %, based on the total weight of the marine diesel engine lubricating oil composition, of a sulfurized, alkaline earth metal alkylphenate detergent which is substantially free of polyol promoter oxidation products.

16 Claims, No Drawings

MARINE DIESEL ENGINE LUBRICATING OIL COMPOSITIONS

BACKGROUND OF THE INVENTION

1. Technical Field

The present invention generally relates to a marine diesel engine lubricating oil composition.

2. Description of the Related Art

In the not so distant past, rapidly escalating, energy costs, particularly those incurred in distilling crude oil and liquid petroleum, became burdensome to the users of transportation fuels, such as owners and operators of seagoing ships. In response, those users have steered their operations away from steam turbine propulsion units in favor of large marine diesel engines that are more fuel efficient. Diesel engines may generally be classified as slow-speed, medium-speed, or high-speed engines, with the slow-speed variety being used for the largest, deep shaft marine vessels and certain other industrial applications.

Slow-speed diesel engines are unique in size and method of operation. The engines themselves are massive, the larger units may approach 200 tons in weight and an upward of 10 feet in length and 45 feet in height. The output of these engines can reach as high as 100,000 brake horsepower with engine revolutions of 60 to about 200 revolutions per minute. They are typically of crosshead design and operate on the two-stroke cycle.

Medium-speed engines, on the other hand, typically operate in the range of about 250 to about 1100 rpm and may operate on either the four-stroke or the two-stroke cycle. These engines can be of trunk piston design or occasionally of crosshead design. They typically operate on residual fuels, just like the slow-speed diesel engines, but some may also operate on distillate fuels that contain little or no residue. These engines can also be used for propulsion, ancillary applications or both on deep-sea vessels.

Slow- and medium-speed diesel engines are also extensively used in power plant operations. A slow- or medium-speed diesel engine that operates on the 2-stroke cycle is typically a direct-coupled and direct-reversing engine of crosshead construction, with a diaphragm and one or more stuffing boxes separating the power cylinders from the crankcase to prevent combustion products from entering the crankcase and mixing with the crankcase oil. The notable complete separation of the crankcase from the combustion zone has led persons skilled in the art to lubricate the combustion chamber and the crankcase with different lubricating oils.

Accordingly, in large diesel engines of the crosshead type used in marine and heavy stationary applications, the cylinders are lubricated separately from the other engine components. The cylinders are lubricated on a total loss basis with the cylinder oil being injected separately to quills on each cylinder by means of lubricators positioned around the cylinder liner. Oil is distributed to the lubricators by means of pumps, which are, in modern engine designs, actuated to apply the oil directly onto the rings to reduce wastage of the oil.

The high stresses encountered in these engines and the use of residual fuels creates the need for lubricants with a high detergency and neutralizing capability even though the oils are exposed to thermal and other stresses only for short periods of time. Residual fuels commonly used in these diesel engines typically contain significant quantities of sulfur which, in the combustion process, combine with water to form sulfuric acid, the presence of which leads to corrosive wear. In particular, in two-stroke engines for ships, areas around the cylinder liners and piston rings can be corroded and worn by the acid. Therefore, it is important for diesel engine lubricating oils to have the ability to resist such corrosion and wear.

Accordingly, a primary function of marine cylinder lubricants is to neutralize sulfur-based acidic components of high-sulfur fuel oil combusted in slow-speed 2-cycle crosshead diesel engines. This neutralization is accomplished by the inclusion in the marine cylinder lubricant of basic species such as metallic detergents. Unfortunately the basicity of the marine cylinder lubricant can be diminished by oxidation of the marine cylinder lubricant (caused by the thermal and oxidative stress the lubricant undergoes in the engine), thus decreasing the lubricant's neutralization ability. The oxidation can be accelerated if the marine cylinder lubricants contain oxidation catalysts such as wear metals that are generally known to be present in the lubricant during engine operation.

Medium-speed trunk piston engines typically operate using various types and qualities of diesel fuels and heavy fuel oils. These engines are lubricated with trunk piston engine oils which are required to have the ability to form a protective layer between moving surfaces, neutralize acids, and keep contaminants suspended in the oil. Unfortunately, these properties can be adversely affected by oxidation of the oil resulting in viscosity increase, loss of neutralization capacity and loss of detergency.

A need still remains, therefore, for an improved marine diesel engine lubricating oil composition having oxidative stability.

SUMMARY OF THE INVENTION

In accordance with one embodiment of the present invention, a marine diesel engine lubricating oil composition is provided which comprises (a) a major amount of an oil of lubricating viscosity, and (b) about 3 wt. % to about 40 wt. %, based on the total weight of the marine diesel engine lubricating oil composition, of a sulfurized, alkaline earth metal alkylphenate detergent which is substantially free of polyol promoter oxidation products, the sulfurized, alkaline earth metal alkylphenate detergent being prepared by the process comprising (i) contacting an alkylphenol having at least one alkyl substituent from 6 to 36 carbon atoms with sulfur, in the presence of a promoter acid selected from the group of alkanoic acids having 1 through 3 carbon atoms, mixtures of the alkanoic acids, alkaline earth metal salts of the alkanoic acids and mixtures thereof, and at least a stoichiometric amount of a calcium base sufficient to neutralize the alkylphenol and the promoter at a temperature of from about 130° C. to about 250° C. under reactive conditions in the absence of a polyol promoter or an alkanol having 1 to 5 carbon atoms for to sufficient period of time to react essentially all of the sulfur thereby yielding a calcium sulfurized alkylphenate essentially free of elemental sulfur; and (ii) contacting the reaction product of step (i) with carbon dioxide and additional calcium base, if required, to provide the desired TBN, in the presence of an alkylene glycol having 2 to 6 carbon atoms under reactive conditions at a temperature of from about 150° C. to about 260° C., wherein the marine diesel engine lubricating oil composition has a total base number (TBN) of from about 20 to about 100.

In accordance with a second embodiment of the present invention, there, is provided a method for improving oxidative stability of a marine diesel engine lubricating oil composition used in a marine diesel engine, the method comprising adding about 3 wt. % to about 40 wt. % based on the total weight of the marine diesel engine lubricating oil composition, of a sulfurized alkaline earth metal alkylphenate detergent which is substantially free of polyol promoter oxidation products to a marine diesel engine lubricating oil composition comprising a major amount of an oil of lubricating viscosity to form a marine diesel engine lubricating oil composition having a TBN of from about 20 to about 100, wherein the sulfurized, alkaline earth metal alkylphenate detergent is prepared by a process comprising (i) contacting an alkylphenol having at least one alkyl substituent from 6 to 36 carbon atoms with sulfur, in the presence of a promoter acid selected from the group of alkanoic acids having 1 through 3 carbon atoms, mixtures of said alkanoic acids, alkaline earth metal salts of said alkanoic acids and mixtures thereof, and at least a stoichiometric amount of a calcium base sufficient to neutralize the alkylphenol and the promoter at a temperature of from about 130° C. to about 250° C. under reactive conditions in the absence of a polyol promoter or an alkanol having 1 to 5 carbon atoms for a sufficient period of time to react essentially all of the sulfur thereby yielding a calcium sulfurized alkylphenate essentially free of elemental sulfur; and (ii) contacting the reaction product of step (i) with carbon dioxide and additional calcium base, if required, to provide the desired TBN, in the presence of an alkylene glycol having 2 to 6 carbon atoms under reactive conditions at temperature of from about 150° C. to about 260° C.

In accordance with a third embodiment of the present invention, the use of about 3 wt. % to about 40 wt, %, based on the total weight of the marine diesel engine lubricating oil composition, of a sulfurized, alkaline earth metal alkylphenate detergent which is substantially free of polyol promoter oxidation products for improving oxidative stability of a marine diesel engine lubricating oil composition used in a marine diesel engine and having a TBN of from about 20 to about 100 and comprising a major amount of an oil of lubricating viscosity, wherein the sulfurized, alkaline earth metal alkylphenate detergent is prepared by a process comprising (i) contacting an alkylphenol having at least one alkyl substituent from 6 to 36 carbon atoms with sulfur, in the presence of a promoter acid selected from the group of alkanoic acids having 1 through 3 carbon atoms, mixtures of said alkanoic acids, alkaline earth metal salts of said alkanoic acids and mixtures thereof, and at least a stoichiometric amount of a calcium base sufficient to neutralize the alkylphenol and the promoter at a temperature of from about 130° C. to about 250° C. under reactive conditions in the absence of a polyol promoter or an alkanol having 1 to 5 carbon atoms thr a sufficient period of tin to react essentially all of the sulfur thereby yielding a calcium sulfurized alkylphenate essentially free of elemental sulfur, and (ii) contacting the reaction product of step (i) with carbon dioxide and additional calcium base, if required, to provide the desired FUN, in the presence of an alkylene glycol having 2 to 6 carbon atoms under reactive conditions at temperature of from about 150° C. to about 260° C.

The present invention is based on the surprising discovery that a sulfurized, alkaline earth metal alkylphenate detergent prepared by the process described herein advantageously improves the oxidative stability of a marine diesel engine lubricating oil composition having a TBN of from about 20 to about 100 when employed in an amount of about 3 wt. % to about 40 wt, %, based on the total weight of the marine, diesel engine lubricating oil composition as compared to a sulfurized, alkaline earth metal alkylphenate detergent prepared by a process which employs a polyol promoter such as, e.g., alkylene glycol in step (i) of the process disclosed hereinabove.

DETAILED DESCRIPTION OF THE PREFERRED EMBODIMENTS

Definitions

The term "marine diesel engine lubricating oil composition" as used herein shall be understood to mean a marine cylinder lubricant or a trunk piston engine oil.

The term "marine cylinder lubricant" as used herein shall be understood to mean a lubricant used in the cylinder lubrication of a slow speed or medium speed diesel engine. The marine cylinder lubricant is fed to the cylinder walls through a number of injection points. Marine cylinder lubricants are capable of providing a film between the cylinder liner and the piston rings and holding partially burned fuel residues in suspension, to thereby promote engine cleanliness and neutralize acids formed by, for example, the combustion of sulfur compounds in the fuel.

The term "trunk piston engine oils" are oils used to lubricate both the crankcase and the cylinders of a trunk piston engine. The term "trunk piston" refers to the piston skirt or trunk. The trunk piston transmits the thrust caused by connecting-rod angularity to the side of the cylinder liner, in the same way as the crosshead slipper transmits the thrust to the crosshead guide. Trunk piston engines are generally medium speed (about 250 to about 1000 rpm) 4-stroke compression-ignition (diesel) engines. Accordingly, the trunk piston engine lubricating oil compositions, and trunk piston engine oils (TPEO) described herein (collectively "lubricating oil compositions") can be used fir lubricating any trunk piston engine or compression-ignited (diesel) marine engine, such as a 4-stroke trunk piston engine or 4-stroke diesel marine engine.

A "marine residual fuel" refers to a material combustible in large marine engines which has a carbon residue, as defined in International Organization for Standardization (ISO) 10370) of at least 2.5 wt. % at least 5 wt. %, or at least 8 wt. %) (relative to the total weight of the fuel), a viscosity at 50° C. of greater than 14.0 cSt, such as the marine residual fuels defined in the international Organization for Standardization specification ISO 8217:2005, "Petroleum products—Fuels (class F)—Specifications of marine fuels," the contents of which are incorporated herein in their entirety.

The term "Group II metal" or "alkaline earth metal" means calcium, barium, magnesium, and strontium.

The term "calcium base" refers to a calcium hydroxide, calcium oxide, calcium alkoxide and the like and mixtures thereof.

The term "lime" refers to calcium hydroxide also known as slaked lime or hydrated lime.

The term "overbased calcium sulfurized alkylphenate composition" refers to a composition comprising a small amount of diluent (e.g., lubricating oil) and a calcium sulfurized alkylphenate complex wherein additional alkalinity is provided by a stoichiometric excess of a calcium oxide, hydroxide or $C_1$ to $C_6$ alkoxide based on the amount required to react with the hydroxide moiety of the sulfurized alkylphenol.

The term "lower alkanoic acid" refers to alkanoic acids having, 1 through 3 carbon atoms, i.e., formic acid, acetic acid and propionic acid and mixtures thereof.

The term "alkylphenol" refers to a phenol group having one or more alkyl substituents at least one of which has a sufficient number of carbon atoms to impart oil solubility to the resulting phenate additive.

The term "polyol promoter" refers to a compound having two or more hydroxy substituents, generally the sorbitol type, for example, alkylene glycols and also derivatives thereof and functional equivalents such as polyol ethers and hydroxycarboxylic acids.

The term "Total Base Number" or "TBN" refers to the level of alkalinity in an oil sample, which indicates the ability of the composition to continue to neutralize corrosive acids, in accordance with ASTM Standard No. D2896 or equivalent procedure. The test measures the change in electrical conductivity, and the results are expressed as mgKOH/g (the equivalent number of milligrams of KOH needed to neutralize 1 gram of a product). Therefore, a high TBN reflects strongly overbased products and, as a result, a higher base reserve for neutralizing acids.

The term "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both.

In one embodiment, a marine diesel engine lubricating oil composition is provided which comprises (a) a major amount of an oil of lubricating viscosity and (b) about 3 wt. % to about 40 wt. %, based on the total weight of the marine diesel engine lubricating oil composition, of an overbased sulfurized alkylphenate detergent which is substantially free of polyol promoter oxidation products, the overbased sulfurized alkylphenate detergent being prepared by the process comprising (i) contacting an alkylphenol having at least one alkyl substituent from 6 to 36 carbon atoms with sulfur, in the presence of a promoter acid selected from the group of alkanoic acids having 1 through 3 carbon atoms, mixtures of said alkanoic acids, alkaline earth metal salts of said alkanoic acids and mixtures thereof, and at least a stoichiometric amount of a calcium base sufficient to neutralize the alkylphenol and the promoter at a temperature of from about 130° C. to about 250° C. under reactive conditions in the absence of a polyol promoter or an all having 1 to 5 carbon atoms for a sufficient period of time to react essentially all of the sulfur thereby yielding a calcium sulfurized alkylphenate essentially free of elemental sulfur; and (ii) contacting the reaction product of step (i) with carbon dioxide and additional calcium base, if required, to provide the desired TBN, in the presence of an alkylene glycol having 2 to 6 carbon atoms under reactive conditions at temperature of from about 150° C. to about 260° C., wherein the marine diesel engine lubricating oil composition has a total base number (TBN) of from about 20 to about 100.

The marine diesel engine lubricating oil compositions of this invention will have a total base number (TBN) of from about 20 to about 100. In one embodiment, the marine diesel engine lubricating oil compositions of this invention can have a TBN of from about 40 to about 100. In one embodiment, the marine diesel engine lubricating oil compositions of this invention can have a TBN of from about $0 to about $0. In one embodiment, the marine diesel engine lubricating oil compositions of this invention can have a TBN of from about 40 to about 70. In one embodiment, the marine diesel engine lubricating oil compositions of this invention can have a TBN of from about 20 to about 60.

The marine diesel engine lubricating oil compositions of this invention can have a kinematic viscosity ranging from about 12.5 to about 26.1 centistokes (cSt) at 100° C. The viscosity of the marine diesel engine lubricating oil compositions can be measured by any suitable method, e.g., ASTM D445.

The marine diesel engine lubricating oil compositions of the present invention can be prepared by any method known to a person of ordinary skill in the art for making marine diesel engine lubricating oil compositions. The ingredients can be added in any order and in any manner. Any suitable mixing or dispersing equipment may be used for blending, mixing or solubilizing the ingredients. The blending, mixing or solubilizing may be carried out with a blender, an agitator, a disperser, a mixer (e.g., planetary mixers and double planetary mixers), a homogenizer (e.g., a Gaulin homogenizer or Ratline homogenizer), a mill (e.g., colloid mill, ball mill or sand mill) or any other mixing or dispersing equipment known in the art.

The oil of lubricating viscosity for use in the marine diesel engine lubricating oil compositions of this invention, also referred to as a base oil, is typically present in a major amount, e.g., an amount greater than 50 wt. %, or greater than about 70 wt based on the total weight of the composition. In one embodiment, the oil of lubricating viscosity, is present in an amount of from 70 wt. % to about 95 wt. %, based on the total weight of the composition. In one embodiment, the oil of lubricating viscosity, is present in an amount of from 70 wt, to about 85 wt. %, based on the total weight of the composition. The base oil for use herein can be any presently known or later-discovered oil of lubricating viscosity used in formulating a marine diesel engine lubricating oil compositions for any and all such applications. Additionally, the base oils for use herein can optionally contain viscosity index improvers, e.g., polymeric alkylmethacrylates; olefinic copolymers, e.g., an ethylene-propylene copolymer or a styrene-butadiene copolymer; and the like and mixtures thereof.

As one skilled in the art would readily appreciate, the viscosity of the base oil is dependent upon the application. Accordingly, the viscosity of a base oil for use herein will ordinarily range from about 2 to about 5000 centistokes (cSt) at 100° Centigrade (C). Generally, individually the base oils used herein will have a kinematic viscosity range at 100° C. of about 4 cSt to about 35 cSt. The base oil will be selected or blended depending on the desired end use and the additives in the finished oil to give the desired grade of oil, e.g., a marine diesel engine lubricating oil composition having an SAE Viscosity Grade of 30, 40 50, 60 and the like.

Base stocks may be manufactured using a variety of different processes including, but not limited to, distillation, solvent refining, hydrogen processing, oligomerization, esterification, and rerefining. Rerefined stock shall be substantially free from materials introduced through manufacturing, contamination, or previous use.

The base oil of the lubricating oil compositions of this invention may be any natural or synthetic lubricating base oil. Suitable base oil includes base stocks obtained by isomerization of synthetic wax and slack wax, as well, as hydrocracked base stocks produced by hydrocracking (rather than solvent extracting) the aromatic and polar components of the crude. Suitable base oils include those in all API categories I, II, III, IV and V as defined in API Publication 1509, $16^{th}$ Edition, Addendum I, October, 2009. Group IV base oils are polyalphaolefins (PAD). Group V base oils include all other base oils not included in Group I, II, III, or IV. Although Group I and II base oils are preferred for use in this invention, these base oils may be prepared by combining one or more of Group I, II, III, IV and V base stocks or base oils.

Useful natural oils include mineral lubricating oils such as, for example, liquid petroleum oils, solvent-treated or acid-treated mineral lubricating oils of the paraffinic, naphthenic or mixed paraffinic-naphthenic types, oils derived from coal or shale, animal oils, vegetable oils (e.g., rapeseed oils, castor oils and lard oil), and the like.

Useful synthetic lubricating oils include, but are not limited to, hydrocarbon oils and halo-substituted hydrocarbon oils such as polymerized and interpolymerized olefins, e.g., polybutylenes, polypropylenes, propylene-isobutylene copolymers, chlorinated polybutylenes, poly(1-hexenes), poly(1-octenes), poly(1-decenes), and the like and mixtures thereof; alkylbenzenes such as dodecylbenzenes, tetradecylbenzenes, dinonylbenzenes, di(2-ethylhexyl)-benzenes, and the like; polyphenyls such as biphenyls, terphenyls, alkylated polyphenyls, and the like; alkylated diphenyl ethers and alkylated diphenyl sulfides and the derivative, analogs and homologs thereof and the like.

Other useful synthetic lubricating oils include, but are not limited to, oils made by polymerizing olefins of less than 5 carbon atoms such as ethylene, propylene, butylenes, isobutene, pentene, and mixtures thereof. Methods of preparing such polymer oils are well known to those skilled in the art.

Additional useful synthetic hydrocarbon oils include liquid polymers of alpha olefins having the proper viscosity. Especially useful synthetic hydrocarbon oils are the hydrogenated liquid oligomers of $C_6$ to $C_{12}$ alpha olefins such as, for example, 1-decene trimer.

Another class of useful synthetic lubricating oils includes, but is not limited to, alkylene oxide polymers, i.e., homopolymers, interpolymers, and derivatives thereof where the terminal hydroxyl groups have been modified by, for example, esterification or etherification. These oils are exemplified by the oils prepared through polymerization of ethylene oxide or propylene oxide, the alkyl and phenyl ethers of these polyoxyalkylene polymers (e.g., methyl poly propylene glycol ether having an average molecular weight of 1,000, diphenyl ether of polyethylene glycol having a molecular weight of 500 to 1000, diethyl ether of polypropylene glycol having a molecular weight of 1,000 to 1,500, etc.) or mono- and polycarboxylic esters thereof such as, for example, the acetic esters, mixed $C_3$ to $C_8$ fatty acid esters, or the $C_{13}$ oxo acid diester of tetraethylene glycol.

Yet another class of useful synthetic lubricating oils include, but are not limited to, the esters of dicarboxylic acids e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acids, alkyl malonic acids, alkenyl malonic acids, etc., with a variety of alcohols, e.g., butyl alcohol, hexyl alcohol, dodecyl alcohol, 2-ethylhexyl alcohol, ethylene glycol, diethylene glycol monoether, propylene glycol, etc. Specific examples of these esters include dibutyl adipate, di(2-ethylhexyl)sebacate, di-n-hexyl fumarate, dioctyl sebacate diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include, but are not limited to, those made from carboxylic acids having from about 5 to about 12 carbon atoms with alcohols, e.g., methanol, ethanol, etc., polyols and polyol ethers such as neopentyl trimethylol propane, pentaerythritol, dipentaerythritol, tripentaerythritol, and the like.

Silicon-based oils such as, for example, polyalkyl-, polyaryl-, polyalkoxy- or polyaryloxy-siloxane oils and silicate oils, comprise another useful class of synthetic lubricating oils. Specific examples of these include, but are not limited to, tetraethyl silicate, tetra-isopropyl silicate, tetra-(2-ethylhexyl) silicate, tetra-(4-methyl-hexyl)silicate, tetra-(p-tert-butylphenyl)silicate, hexyl-(4-methyl-2-pentoxy)disiloxane, poly(methyl)siloxanes, poly(methylphenyl)siloxanes, and the like. Still yet other useful synthetic lubricating oils include, but are not limited to liquid esters of phosphorous containing acids, e.g., tricresyl phosphate, trioctyl phosphate, diethyl ester of decane phosphionic acid, etc., polymeric tetrahydrofurans and the like.

The lubricating oil may be derived from unrefined, refined and rerefined oils, either natural, synthetic or mixtures of two or more of any of these of the type disclosed hereinabove. Unrefined oils are those obtained directly from a natural or synthetic source (e.g., coal, shale, or tar sands bitumen without further purification or treatment. Examples of unrefined oils include, but are not limited to, a shale oil obtained directly from retorting operations, a petroleum oil obtained directly from distillation or an ester oil obtained directly from an esterification process, each of which is then used without further treatment. Refined oils are similar to the unrefined oils except they have been further treated in one or more purification steps to improve one or more properties. These purification techniques are known to those of skill in the art and include, for example, solvent extractions, secondary distillation, acid or base extraction, filtration, percolation, hydrotreating, dewaxing, etc. Rerefined oils are obtained by treating used oils in processes similar to those used to obtain refined oils. Such rerefined oils are also known as reclaimed or reprocessed oils and often are additionally processed by techniques directed to removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst.

Natural waxes are typically, the slack waxes recovered by the solvent dewaxing of mineral oils; synthetic waxes are typically the wax produced by the Fischer-Tropsch process. Examples of useful oils of lubricating viscosity include HVI and XHVI basestocks, such isomerized wax base oils and UCBO (Unconventional Base Oils) base oils.

The marine diesel engine lubricating oil compositions of the present invention also contain as component (b) from about 3 wt. % to about LIU wt. based on the total weight of the marine diesel engine lubricating oil composition, of an overbased sulfurized alkylphenate detergent which is substantially free of polyol promoter oxidation products. In general, the overbased sulfurized alkylphenate detergent which is substantially free of polyol promoter oxidation products is obtained by the process comprising (i) contacting an alkylphenol having at least one alkyl substituent from 6 to 36 carbon atoms with sulfur, in the presence of a promoter acid selected from the group of alkanoic acids having 1 through 3 carbon atoms, mixtures of the alkanoic acids, alkaline earth metal salts of the alkanoic acids and mixtures thereof, and at least a stoichiometric amount of a calcium base sufficient to neutralize the alkylphenol and the promoter at a temperature of from about 130° C. to about 250° C. under reactive conditions in the absence of a polyol promoter or an alkanol having 1 to 5 carbon atoms for a sufficient period of time to react essentially all of the sulfur thereby yielding a calcium sulfurized alkylphenate essentially free of elemental sulfur; and (ii) contacting the reaction product of step (i) with carbon dioxide and additional calcium base, if required, to provide the desired TBN, in the presence of an alkylene glycol having 2 to 6 carbon atoms under reactive conditions at a temperature of from about 150° C. to about 260° C., see, e.g., U.S. Pat. No. 5,529,705, the contents of which are incorporated by reference herein.

The process for preparing the sulfurized, alkaline earth metal alkylphenate detergent can be conveniently conducted by contacting the desired alkylphenol with sulfur in the presence of a lower alkanoic acid and calcium base under reactive conditions. If desired, the alkylphenol can be contacted with sulfur in an inert compatible liquid hydrocarbon diluent. The reaction can be conducted under an inert gas, such as nitrogen, in theory the neutralization can be conducted as a separate step prior to sulfurization, but it is generally more convenient to conduct the sulfurization and the neutralization together in a single process step. Also, in place of the lower alkanoic acid, salts of the alkanoic acids or mixtures of the acids and salts could also be used. Where salts or mixtures of salts and acids are used, the salt is preferably an alkaline earth metal salt such as a calcium salt. En general, the acids are preferred and the process will be described below with respect to the use of lower alkanoic acid; however, it should be appreciated that the teachings are also applicable to the use of salts and mixtures of salts in place of all or a portion of the acids.

The combined neutralization and sulfurization reaction is typically conducted at temperatures in the range of about from about 115° C. to about 250° C. or from about 135° C. to about 230° C. depending on the particular alkanoic acid used. Where formic acid is used, a temperature in the range of about 150° C. to about 200° C. can be used. Where acetic acid or propionic acid are used, higher reaction temperatures may be advantageously employed, for example, at temperatures in the range of about 180° C. to about 250° C. or from about 200° C. to about 235° C.

If desired, mixtures of two or all three of the lower alkanoic acids also can be used. For example, mixtures containing about from about 5 to about 25 wt formic acid and about from about 75 to about 95 wt acetic acid can be used where low or medium overbased products are desired. Based on one mole of alkylphenol typically, from about 0.8 to about 3.5, preferably about 1.2 to about 2 moles of sulfur and about 0.025 to about 2, preferably about 0.1 to about 0.8 moles of lower alkanoic acid are used. Typically, about 0.3 to about 1 mole preferably, about 0.5 to about 0.8 mole of calcium base are employed per mole of alkylphenol.

In addition, an amount of calcium base sufficient to neutralize the lower alkanoic acid is also used. Thus, from about 0.31 to about 2 moles of calcium base are used per mole of alkylphenol including the base required to neutralize the lower alkanoic acid. If preferred, lower alkanoic acid to alkylphenol and calcium base to alkylphenol ratios are used, the total calcium base to alkylphenol ratio range will be about from about 0.55 to about 1.2 moles of calcium base per mole of alkylphenol. As one skilled in the art will readily appreciate, this additional calcium base will not be required where salts of alkanoic acids are used in place of the acids.

The reaction may be carried out in a compatible liquid diluent, such as a low viscosity mineral or synthetic oil. The reaction is conducted for a sufficient length of time to ensure complete reaction of the sulfur, e.g., where high TBN products are desired because the synthesis of such products generally requires using carbon dioxide together with a polyol promoter. Accordingly, any unreacted sulfur remaining in the reaction mixture will catalyze the formation of deleterious oxidation products of the polyol promoter during the overbasing step.

Where the neutralization is conducted as a separate step, both the neutralization and the subsequent sulfurization are conducted under the same conditions as set forth above. In either case, it is desirable to remove water generated by the neutralization of the alkylphenol. This is conventional and generally is accomplished by continuous distillation during the neutralization. Conveniently, a high molecular weight alkanol having 8 to 16 carbon atoms may be added to the neutralization-sulfurization step and/or the overbasing step as a solvent and also to assist in the removal of water by forming a water-azeotrope which may then be distilled off.

Optionally specialized sulfurization catalysts such as those described in U.S. Pat. No. 4,744,921, the disclosure of which is hereby incorporated in its entirety, can be employed in the neutralization-sulfurization reaction together with the lower alkanoic acid. However, any benefit afforded by the sulfurization catalyst, for example, reduced reaction time, is offset by the increase in costs incurred by the catalyst and/or the presence of undesired residues in the case of halide catalysts or alkali metal sulfides; especially, as excellent reaction rates can be obtained by merely using acetic and/or propionic acid and increasing reaction temperatures.

If a high TBN product is desired, the sulfurized alkylphenate reaction product can be overbased by carbonation. Such carbonation can be conveniently effected by addition of a polyol promoter, such as an alkylene diol, e.g., ethylene glycol, and carbon dioxide to the sulfurized alkylphenate reaction product. Additional calcium base can be added at this time and/or excess calcium base can be used in the neutralization step. In one embodiment, an alkenyl succinimide or a neutral or overbased Group II metal hydrocarbylsulfonate is added to either the neutralization-sulfurization reaction mixture or overbasing reaction mixture. The succinimide or sulfonate assists in solubilizing both the alkylphenol and the phenate reaction product and therefore, when used, may be added to the initial reaction mixture.

Overbasing is typically conducted at temperatures in the range of above from about 160° C. to about 190° C. or from about 170° C. to about 180° C. for about 0.1 to about 4 hours, depending on whether a medium or high TBN product is desired. Conveniently, the reaction is conducted by the simple expedient of bubbling gaseous carbon dioxide through the reaction mixture. Excess diluent and any water formed during the overbasing reaction can be conveniently removed by distillation either during or after the reaction.

Carbon dioxide is employed in the reaction system in conjunction with the calcium base to form the overbased product and is typically employed at a ratio of about from about 0.5 to about 2 moles per mole of alkylphenol, or from about 0.75 to about 1.5 moles per mole of alkylphenol. The amount of $CO_2$ incorporated into the calcium overbased sulfurized alkylphenate provides for a $CO_2$ to calcium weight ratio of about from about 0.55 to about 0.7. All of the calcium base including the excess used for overbasing may be added in the neutralization or a portion of the Group II base can be added prior to carbonation.

Where a medium TBN product (a TBN of about 150 to 225) is desired, a stoichiometric amount or slight excess of calcium base can be used in the neutralization step; for example, about 0.5 to about 1.3 moles of base per mole of alkylphenol in addition to the amount needed to neutralize the lower alkanoic acid. High TBN products are typically prepared by using a mole ratio of calcium base to alkylphenol of about 1 to about 2.5 or about 1.5 to about 2; a carbon dioxide mole ratio of about 0.5 to about 2 or from about 0.75 to about 1.5 moles of carbon dioxide per mole of alkylphenol and about 0.5 to about 2.5, or about 1.2 to about 2 moles of alkylene glycol. Again where lower alkanoic acids are used, in contrast to their salts, an additional amount of calcium salt sufficient to neutralize the lower alkanoic acid should be used.

As noted above all of the excess calcium base needed to produce a high TBN product can be added in the neutralization-sulfurization step or the excess above, that needed to neutralize the alkylphenol can be added in the overbasing step or divided in any proportion between the two steps. Typically, where very high TBN products are desired, a portion of the calcium base will be added in the overbasing step. The neutralization reaction mixture or overbasing reaction mixture may also contain about 1 to about 20, or about 5 to about 15 weight percent of a neutral or overbased sulfonate and/or an alkenyl succinimide based on the weight of alkylphenol. (In general where high TBN are desired, TBN in the range of about from 250 to 300 are preferred.)

Typically, the process is conducted under vacuum up to a slight pressure, i.e., pressures ranging from about 25 mm Hg absolute to about 850 mm Hg absolute or is conducted under vacuum to reduce foaming up to atmospheric pressure, e.g., about from about 40 mm Hg absolute to about 760 mm Hg absolute.

Additional details regarding the general preparation of sulfurized phenates can be found in, for example, U.S. Pat. Nos. 2,680,096; 3,178,368 and 3,801,507, the contents of which are incorporated herein by reference.

Considering now in detail, the reactants and reagents used in the present process, first all allotropic forms of sulfur can be used. The sulfur can be employed either as molten sulfur or as solid (e.g., powder or particulate) or as a solid suspension in a compatible hydrocarbon liquid.

It is desirable to use calcium hydroxide as the calcium base because of its handling convenience versus, for example, calcium oxide, and also because it affords excellent results. Other calcium bases can also be used for example, calcium alkoxides.

Suitable alkylphenols which can be used are those wherein the alkyl substituents contain a sufficient number of carbon atoms to render the resulting overbased sulfurized calcium alkylphenate composition oil-soluble. Oil solubility may be provided by a single long chain alkyl substitute or by a combination of alkyl substituents. Typically, the alkylphenol used in the present process will be a mixture of different alkylphenols, e.g., $C_{20}$ to $C_{24}$ alkylphenol. Where phenate products having a TBN of 275 or less are desired, it is economically advantageous to use 100% polypropenyl substituted phenol because of its commercial availability and generally lower costs. Where higher TBN phenate products desired, about 25 to about 100 mole percent of the alkylphenol can have straight-chain alkyl substituent of from about 15 to about 35 carbon atoms and from about 75 to about 0 mole percent in which the alkyl group is polypropenyl of from 9 to 18 carbon atoms. In one embodiment, about 35 to about 100 mole percent of the alkylphenol, the alkyl group will be a straight-chain alkyl of about 15 to about 35 carbon atoms and about from about 65 to 0 mole percent of the alkylphenol, the alkyl group will be polypropenyl of from about 9 to about 18 carbon atoms. The use of an increasing amount of predominantly straight chain alkylphenols results in high TBN products generally characterized by lower viscosities. On the other hand, while polypropenylphenols are generally more economical than predominantly straight chain alkylphenols, the use of greater than about 75 mole percent polypropenylphenol in the preparation of calcium overbased sulfurized alkylphenate compositions generally results in products of undesirably high viscosities. However, use of a mixture of from about 75 mole percent or less of polypropenylphenol of from about 9 to about 18 carbon atoms and from about 25 mole percent or more of predominantly straight chain alkylphenol of from about 15 to about 35 Carbon atoms allows for more economical products of acceptable viscosities.

The alkylphenols can be para-alkylphenates or ortho alkylphenols. Since it is believed that p-alkylphenols facilitate the preparation of highly overbased calcium sulfurized alkylphenate where overbased products are desired, the alkylphenol is preferably predominantly a para alkylphenol with no more than about 45 mole percent of the alkylphenol being ortho alkylphenols; and more preferably no more than about 35 mole percent of the alkylphenol is ortho alkylphenol. Alkyl-hydroxy toluenes or xylenes, and other alkyl phenols having one or more alkyl substituents in addition to at least one long chained alkyl substituent can also be used.

In general, the selection of alkylphenols can be based on the properties desired for the marine diesel engine lubricating oil compositions, notably TBN, and oil solubility. For example, in the case of alkylphenate having substantially straight chain alkyl substituents, the viscosity of the alkylphenate composition can be influenced by the position of an attachment on alkyl chain to the phenyl ring, e.g., end attachment versus middle attachment. Additional information regarding this and the selection and preparation of suitable alkylphenols can be found, for example, in U.S. Pat. Nos. 5,024,773, 5,320,763; 5,318,710, and 5,320,762, each of which are incorporated herein by reference.

If a supplemental sulfurization catalyst is employed, it is typically employed at from about 0.5 to about 10 wt. % relative to the alkylphenol in the reaction system or from about 1 to about 2 wt. %. In one embodiment, the sulfurization catalyst is added to the reaction mixture as a liquid. This can be accomplished by dissolving the sulfurization catalyst in molten sulfur or in the alkylphenol as a premix to the reaction.

The overbasing procedure used to prepare a high TBN overbased sulfurized calcium alkylphenate composition can also employ a polyol promoter, typically a $C_2$ to $C_4$ alkylene glycol, such as ethylene glycol in the overbasing step.

Suitable high molecular weight alkanol which can be used in the neutralization-sulfurization and overbasing are those containing 8 to 16, or 9 to 15, carbon atoms. When employed, the alkanol is typically employed at a molar charge of from about 0.5 to about 5 moles or from about 0.5 to about 4 moles or from about 1 to about 2 moles of high molecular alkanol per mole of alkylphenol. Examples of suitable alkanols include 1-octanol, 1-decanol (decyl alcohol), 2-ethyl-hexanol, and the like. It can be beneficial to use a high molecular weight alcohol in the process because it acts as a solvent and also forms an azeotrope with water and hence facilitates affords a convenient way to remove the water generated by the neutralization or any other water in the system, by azeotropic distillation either after or preferably during the reaction. The high molecular weight alcohol may also play some pan in the chemical reaction mechanism in the sense that it facilitates the removal of the byproduct water during the reaction, thus pushing the reaction to the right of the reaction equation.

In the general preparation of overbased calcium sulfurized alkylphenates, demulsifiers can be added to enhance the hydrolytic stability of the overbased sulfurized calcium alkylphenate and may be similarly employed in the present process if desired. Suitable demulsifiers which can be used include, by way of example, nonionic detergents. When used, demulsifiers are generally added at from about 0.1 to about 1 wt. % to the alkylphenol.

The marine diesel engine lubricating oil compositions of the present invention may also contain conventional marine diesel engine lubricating oil composition additives for imparting auxiliary functions to give a marine, diesel engine lubricating oil composition in which these additives are dispersed or dissolved. For example, the marine diesel engine lubricating oil compositions can be blended with antioxidants, ashless dispersants, detergents other than the sulfurized, alkaline earth metal alkylphenate detergent component (b), antiwear agents, rust inhibitors, dehazing agents, demulsifying agents, metal deactivating agents, friction modifiers, pour point depressants, antifoaming agents, co-solvents, package compatibilisers, corrosion-inhibitors, dyes, extreme pressure agents and the like and mixtures thereof. A variety of the additives are known and commercially available. These additives, or their analogous compounds, can be employed for the preparation of the marine diesel engine lubricating oil compositions of the invention by the usual blending procedures.

In one embodiment, the marine diesel engine lubricating oil compositions of the present invention contain essentially no thickener (i.e., a viscosity index improver).

Examples of antioxidants include, but are not limited to, aminic types, e.g., diphenylamine, phenyl-alpha-napthylamine N,N-di(alkylphenyl) amines and alkylated phenylene-diamines; phenolics such as, for example, BHT, sterically hindered alkyl phenols such as 2,6-di-tert-butylphenol, 2,6-di-tert-butyl-p-cresol and 2,6-di-tert-butyl-4-(2-octyl-3-propanoic) phenol; and mixtures thereof.

The ashless dispersant compounds employed in the marine diesel engine lubricating oil compositions of the present invention are generally used to maintain in suspension insoluble materials resulting from oxidation during use thus preventing sludge flocculation and precipitation or deposition on metal parts. Dispersants may also function to reduce changes in lubricating, oil viscosity by preventing the growth of large contaminant particles in the lubricant. The dispersant employed in the present invention may be any suitable ashless dispersant or mixture of multiple ashless dispersants for use in a marine diesel engine lubricating oil composition. An ashless dispersant generally comprises an oil soluble polymeric hydrocarbon backbone having functional groups that are capable of associating with particles to be dispersed.

In one embodiment, an ashless dispersant is one or more basic nitrogen-containing ashless dispersants. Nitrogen-containing basic ashless (metal-free) dispersants contribute to the base number or BN (as can be measured by ASTM D 2896) of a lubricating oil composition to which they are added, without introducing additional sulfated ash. Basic nitrogen-containing ashless dispersants useful in this invention include hydrocarbyl succinimides; hydrocarbyl succinamides; mixed ester/amides of hydrocarbyl-substituted succinic acids formed by reacting a hydrocarbyl-substituted succinic acylating agent stepwise or with a mixture of alcohols and amines, and/or with amino alcohols; Mannich condensation products of hydrocarbyl-substituted phenols, formaldehyde and polyamines; and amine dispersants formed by reacting high molecular weight aliphatic or alicyclic halides with amines, such as polyalkylene polyamines. Mixtures of such dispersants can also be used.

Representative examples of ashless dispersants include, but are not limited to, amines, alcohols, amides, or ester polar moieties attached to the polymer backbones via bridging groups. An ashless dispersant of the present invention may be, for example, selected from oil soluble salts, esters, amino-esters, amides, imides, and oxazolines of long cha hydrocarbon substituted mono and dicarboxylic acids or their anhydrides; thiocarboxylate derivatives of long chain hydrocarbons, long chain aliphatic hydrocarbons having a polyamine attached directly thereto; and Mannich condensation products formed by condensing a long chain substituted phenol with formaldehyde and polyalkylene polyamine.

Carboxylic dispersants are reaction products of carboxylic acylating agents (acids, anhydrides, esters, etc.) comprising at least about 34 and preferably at least about 54 carbon atoms with nitrogen containing compounds (such as amines), organic hydroxy compounds (such as aliphatic compounds including monohydric and polyhydric alcohols, or aromatic compounds including phenols and naphthols), and/or basic inorganic materials. These reaction products include imides, amides, and esters.

Succinimide dispersants are a type of carboxylic dispersant. They are produced by reacting hydrocarbyl-substituted succinic acylating agent with organic hydroxy compounds, or with amines comprising at least one hydrogen atom attached to a nitrogen atom, or with a mixture of the hydroxy compounds and amines. The term "succinic acylating agent" refers to a hydrocarbon-substituted succinic acid or a succinic acid-producing compound, the latter encompasses the acid itself. Such materials typically include hydrocarbyl-substituted succinic acids, anhydrides, esters (including half esters) and halides.

Succinic-based dispersants have a wide variety of chemical structures. One class of succinic-based dispersants may be represented by the formula:

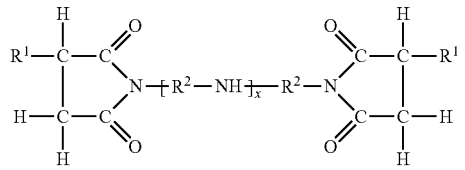

wherein each $R^1$ is independently a hydrocarbyl group, such as a polyolefin-derived group. Typically the hydrocarbyl group is an alkyl group, such as a polyisobutyl group. Alternatively expressed, the $R^1$ groups can contain about 40 to about 500 carbon atoms, and these atoms may be present in aliphatic forms. $R^2$ is an alkylene group, commonly an ethylene ($C_2H_4$) group. Examples of succinimide dispersants include those described in for example, U.S. Pat. Nos. 3,172,892, 4,234,435 and 6,165,715.

The polyalkenes from which the substituent groups are derived are typically homopolymers and interpolymers of polymerizable olefin monomers of 2 to about 16 carbon atoms, and usually 2 to 6 carbon atoms. The amines which are reacted with the succinic acylating agents to form the carboxylic dispersant composition can be monoamines or polyamines.

Succinimide dispersants are referred to as such since they normally contain nitrogen largely in the form of imide functionality, although the amide functionality may be in the form of amine salts, amides, imidazolines as well as mixtures thereof. To prepare a succinimide dispersant, one or more succinic acid-producing compounds and one or more amines are heated and typically water is removed, optionally in the presence of a substantially inert organic liquid solvent/diluent. The reaction temperature can range from about 80° C. up to the decomposition temperature of the mixture or the product, which typically falls between about 100° C. to about 300° C. Additional details and examples of procedures for preparing the succinimide dispersants of the present invention include those described in, for example, U.S. Pat. Nos. 3,172,892, 3,219,666, 3,272,746, 4,234,435, 6,165,235 and 6,440,905.

Suitable ashless dispersants may also include amine dispersants, which are reaction products of relatively high molecular weight aliphatic halides and amines, preferably polyalkylene polyamines. Examples of such amine dispersants include those described in, for example, U.S. Pat. Nos. 3,275,554, 3,438,757, 3,454,555 and 3,565,804.

Suitable ashless dispersants may further include "Mannich dispersants," which are reaction products of alkyl phenols in which the alkyl group contains at least about 30 carbon atoms with aldehydes (especially formaldehyde) and amines (especially polyalkylene polyamines). Examples of such dispersants include those described in, for example, U.S. Pat. Nos. 3,036,003, 3,586.629, 3,591,598 and 3,980,569.

Suitable ashless dispersants may also be post-treated ashless dispersants such as post-treated succinimides, e.g., post-treatment processes involving borate or ethylene carbonate as disclosed in, for example, U.S. Pat. Nos. 4,612,132 and 4,746,446; and the like as well as other post-treatment processes. The carbonate-treated alkenyl succinimide is a polybutene succinimide derived from polybutenes having a molecular weight of about 450 to about 3000, preferably from about 900 to about 2500, more preferably from about 1300 to about 2400 and most preferably from about 2000 to about 2400, as well a mixtures of these molecular weights. Preferably, it is prepared by reacting under reactive conditions, is mixture of a polybutene succinic acid derivative, an unsaturated acidic reagent copolymer of an unsaturated acidic reagent and art olefin, and a polyamine, such as disclosed in U.S. Pat. No. 5,716,912, the contents of which are incorporated herein by reference.

Suitable ashless dispersants may also be polymeric, which are interpolymers of oil-solubilizing monomers such as decyl methacrylate, vinyl decyl ether and high molecular weight olefins with monomers containing polar substitutes. Examples of polymeric dispersants include those described in, for example, U.S. Pat. Nos. 3,329,658; 3,449,250 and 3,666,730.

In one preferred embodiment of the present invention, an ashless dispersant for use in the mat me diesel engine lubricating oil composition is a bis-succinimide derived from a polyisobutenyl group having a number average molecular weight of about 700 to about 2300. The dispersant(s) for use in the lubricating oil compositions of the present invention are preferably non-polymeric (e.g., are mono- or bis-succinimides).

Metal-containing or ash-forming detergents function as both detergents to reduce or remove deposits and as acid neutralizers or rust inhibitors, thereby reducing wear and corrosion and extending engine life. Detergents generally comprise a polar head with a long hydrophobic tail. The polar head comprises a metal salt of an acidic organic compound. The salts may contain a substantially stoichiometric amount of the metal in which case they are usually described as normal or neutral salts, and would typically have a total base number or TBN (as can be measured by ASTM D2896) of from 0 to about 80. A large amount of a metal base may be incorporated by reacting excess metal compound (e.g., art oxide or hydroxide) with an acidic gas (e.g., carbon dioxide). The resulting overbased detergent comprises neutralized detergent as the outer layer of a metal base (e.g., carbonate) micelle. Such overbased detergents may have a TBN of about 100 or greater, and typically will have a TBN of from about 250 to about 450 or more.

Representative examples of metal detergents other than the sulfurized alkaline earth metal alkylphenate detergent component (b) that can be included in the marine diesel engine lubricating oil composition of the present invention include sulfonates, hydroxyaromatic carboxylic acids, phosphonates, and phosphinates. Commercial products are generally referred to as neutral or overbased. Overbased metal detergents are generally produced by carbonating a mixture of hydrocarbons, detergent acid, for example: sulfonic acid, carboxylate etc., metal oxide or hydroxides (for example calcium oxide or calcium hydroxide) and promoters such as xylene, methanol and water. For example, for preparing an overbased calcium sulfonate, in carbonation, the calcium oxide or hydroxide reacts with the gaseous carbon dioxide to form calcium carbonate. The sulfonic acid is neutralized with an excess of CaO or $Ca(OH)_2$, to form the sulfonate.

In one embodiment, the detergent can be one or more alkali or alkaline earth metal salts of an alkyl-substituted hydroxyaromatic carboxylic acid. Suitable hydroxyaromatic compounds include mononuclear monohydroxy and polyhydroxy aromatic hydrocarbons having 1 to 4, and preferably 1 to 3, hydroxyl groups. Suitable hydroxyaromatic compounds include phenol, catechol, resorcinol, hydroquinone, pyrogallol, cresol, and the like. The preferred hydroxyaromatic compound is phenol.

The alkyl substituted moiety of the alkali or alkaline earth metal salt of an alkyl-substituted hydroxyaromatic carboxylic acid is derived from an alpha olefin having from about 10 to about 80 carbon atoms. The olefins employed may be linear, isomerized linear, branched or partially branched linear. The olefin may be a mixture of linear olefins, a mixture of isomerized linear olefins, a mixture of branched olefins, a mixture of partially branched linear or a mixture of any of the foregoing.

In one embodiment, the mixture of linear olefins that may be used is a mixture of normal alpha olefins selected from olefins having from about 12 to about 30 carbon atoms per molecule. In one embodiment, the normal alpha olefins are isomerized using at least one of a solid, or liquid catalyst.

In another embodiment, the olefins are a branched olefinic propylene oligomer or mixture thereof having from about 20 to about 80 carbon atoms, i.e., branched chain olefins derived from the polymerization of propylene. The olefins may also be substituted with other functional groups, such as hydroxy groups, carboxylic acid groups, heteroatoms, and the like. In one embodiment, the branched olefinic propylene oligomer or mixtures thereof have from about 20 to about 60 carbon atoms. In one embodiment, the branched olefinic propylene oligomer or mixtures thereof have from about 20 to about 40 carbon atoms.

In one embodiment, at least about 75 mole (e.g., at least about 80 mole %, at least about 85 mole %, at least about 90 mole %, at least about 95 mole %, or at least about 99 mole %) of the alkyl groups contained within the alkali or alkaline earth metal salt of an alkyl-substituted hydroxyaromatic carboxylic acid such as the alkyl groups of an alkaline earth metal salt of an alkyl-substituted hydroxybenzoic acid detergent are a $C_{20}$ or higher. In another embodiment, the alkali or alkaline earth metal salt of an alkyl-substituted hydroxyaromatic carboxylic acid is an alkali or alkaline earth metal salt of an alkyl-substituted hydroxybenzoic acid that is derived from an alkyl-substituted hydroxybenzoic acid in which the alkyl groups are the residue of normal alpha-olefins containing at least 75 mole % $C_{20}$ or higher normal alpha-olefins.

In another embodiment, at least about 50 mole % (e.g., at least about 60 mole %, at least about 70 mole %, at least about 80 mole %, at least about 85 mole at least about 90 mole %, at least about 95 mole %, or at least about 99 mole % of the alkyl groups contained within the alkali or alkaline earth metal salt of an alkyl-substituted hydroxyaromatic carboxylic acid such as the alkyl groups of an alkali or alkaline earth metal salt of an alkyl-substituted hydroxybenzoic acid are about $C_{14}$ to about $C_{18}$.

The resulting alkali or alkaline earth metal salt of an alkyl-substituted hydroxyaromatic carboxylic acid will be a mixture of ortho and para isomers. In one embodiment, the product will contain about 1 to 99% ortho isomer and 99 to 1% para isomer. In another embodiment, the product will contain about 5 to 70% mho and 95 to 30% para isomer.

The alkali or alkaline earth metal salts of an alkyl-substituted hydroxyaromatic carboxylic acid can be neutral or overbased. Generally, an overbased alkali or alkaline earth metal salt of an alkyl-substituted hydroxyaromatic carboxylic acid is one in which the BN of the alkali or alkaline earth metal salts of an alkyl-substituted hydroxyaromatic carboxylic acid has been increased by a process such as the addition of a base source e.g., lime) and an acidic overbasing compound (e.g., carbon dioxide).

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples include those obtained by alkylating benzene, toluene, xylene, naphthalene, diphenyl or their halogen derivatives. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides hydrosulfides, nitrates, borates and ethers of the metal. The amount of metal compound is chosen having regard to the desired TBN of the final product but typically ranges from about 100 to about 220 wt. % (preferably at least about 125 wt. %) of that stoichiometrically required.

Overbased detergents may be low overbased. e.g., an overbased salt having a BN below about 100. In one embodiment, the BN of a low overbased salt may be from about 5 to about 50. In another embodiment, the BN of a low overbased salt may be from about 10 to about 30. In yet another embodiment, the BN of a low overbased salt may be from about 15 to about 20.

Overbased detergents may be medium overbased, e.g., an overbased salt having a BN from about 100 to about 250, in one embodiment, the BN of a medium overbased salt may be from about 100 to about 200. In another embodiment, the BN of a medium overbased salt may be from about 125 to about 175.

Overbased detergents may be high overbased, e.g., an overbased salt having a BN above about 250. In one embodiment, the BN of a high overbased salt may be from about 250 to about 450.

Examples of rust inhibitors include, but are not limited to, nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof; synthetic alkarylsulfonates, e.g., metal dinonylnaphthalene sulfonates; and the like and mixtures thereof.

Examples of friction modifiers include, but are not limited to, alkoxylated fatty amines; borated fatty epoxides; fatty phosphites, fatty epoxides, fatty amines, borated alkoxylated fatty amines, metal salts of limy acids, fatty acid amides, glycerol esters, borated glycerol esters; and fatty imidazolines as disclosed in U.S. Pat. No. 6,372,696, the contents of which are incorporated by reference herein; friction modifiers obtained from a reaction product of a $C_4$ to $C_{75}$, preferably a $C_6$ to $C_{24}$, and most preferably a $C_6$ to $C_{20}$, limy acid ester and a nitrogen-containing compound selected from the group consisting of ammonia, and an alkanolamine and the like and mixtures thereof.

Examples of antiwear agents include, but are not limited to, zinc dialkyldithiophosphates and zinc diaryldithiophosphates, e.g., those described in an article by Born et al. entitled "Relationship between Chemical Structure and Effectiveness of Some Metallic Dialkyl- and Diaryl-dithiophosphates in Different Lubricated Mechanisms", appearing in Lubrication Science 4-2 Jan. 1992, see for example pages 97-100; aryl phosphates and phosphites, sulfur-containing esters, phosphosulfur compounds, metal or ash-free dithiocarbamates, xanthates, alkyl sulfides and the like and mixtures thereof.

Examples of antifoaming agents include, but are not limited to, polymers of alkyl methacrylate; polymers of dimethylsilicone and the like and mixtures thereof.

Examples of a pour point depressant include, but are not limited to, polymethacrylates, alkyl acrylate polymers, alkyl methacrylate polymers, di(tetra-paraffin phenol)phthalate, condensates of tetra-paraffin phenol, condensates of a chlorinated paraffin with naphthalene and combinations thereof. En one embodiment, a pour point depressant comprises an ethylene-vinyl acetate copolymer, a condensate of chlorinated paraffin and phenol, polyalkyl styrene and the like and combinations thereof. The amount of the pour point depressant may vary from about 0.01 wt. % to about 10 wt. %.

Examples of a demulsifier include, but are not limited to, anionic surfactants alkyl-naphthalene sulfonates, alkyl benzene sulfonates and the like), nonionic alkoxylated alkylphenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and the like and combinations thereof. The amount of the demulsifier may vary from about 0.01 wt. % to about 10 wt. %.

Examples of a corrosion inhibitor include, but are not limited to, half esters or aril ides of dodecylsuccinic acid, phosphate esters, thiophosphates, alkyl imidazolines, sarcosines and the like and combinations thereof. The amount of the corrosion inhibitor may vary from about 0.01 wt. % to about 0.5 wt. %.

Examples of an extreme pressure agent include, but are not limited to, sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or cosulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and the like and combinations thereof. The amount of the extreme pressure agent may vary from about (101 wt. % to about 5 wt. %.

Each of the foregoing, additives, when used, is used at a functionally effective amount to impart the desired properties to the lubricant. Thus, for example, if an additive is a friction modifier, a functionally effective amount of this friction modifier would be an amount sufficient to impart the desired friction modifying, characteristics to the lubricant. Generally, the concentration of each of these additives, when used, ranges from about 0.001% to about 20% by weight, and in one embodiment about 0.01% to about 10% by weight based on the total weight of the lubricating oil composition.

If desired, the sulfurized alkaline earth metal alkylphenate detergent component (b) and/or the marine diesel engine lubricating oil composition additives may be provided as an additive package or concentrate in which the additives are incorporated into a substantially inert, normally liquid organic diluent such as, for example, mineral oil, naphtha, benzene, toluene or xylene to form an additive concentrate. These concentrates usually contain from about 20% to about 80% by weight of such diluent. Typically a neutral oil having a viscosity of about 4 to about 8.5 cSt at 100° C. and preferably about 4 to about 6 cSt at 100° C. will be used as the diluent, though synthetic oils, as well as other organic liquids which are compatible with the additives and finished lubricating oil can also be used. The additive package will typically contain one or more of the various additives, referred to above, in the desired amounts and ratios to facilitate direct combination with the requisite amount of the oil of lubricating viscosity.

The resulting marine diesel engine lubricating oil composition can be used for applications associated with, for example, marine cylinder lubricants, truck piston engine lubricants and the like.

The following non-limiting examples are illustrative of the present invention.

The tendency of marine lubricants to resist oxidation which can lead to, for example, a decrease in Total Base Number during use, can be evaluated using the Modified Institute of Petroleum 48 (MIP-48) Test.

Modified Institute of Petroleum 48 (MIP-48) Test

This test measures the degree of stability against oxidation-based viscosity increase of the lubricant. The test consists of a thermal and an oxidative part. During both parts of the test the test samples are heated for a period of time. In the thermal part of the test, nitrogen is passed through a heated oil sample for 24 hours and in parallel during the oxidative part of the test, air is passed through a heated oil sample for 24 hours. The two samples were then cooled, and the viscosities of the samples were determined. The BN depletion and viscosity increase of the test oil caused by oxidation are determined and corrected for the thermal effect. The oxidation-based viscosity increase for each marine system oil composition was calculated by subtracting the kinematic viscosity at 100° C. of the nitrogen-blown sample from the kinematic viscosity at 100° C. for the air-blown sample, and dividing the subtraction product by the kinematic viscosity at 100° C. for the nitrogen blown sample.

TPP Content

The concentration of total free unsulfurized alkylhydroxyaromatic compound and its unsulfurized metal salts (i.e., "total TPP" or "total residual TPP") in detergent described hereinbelow was determined by reverse phase High Performance Liquid Chromatography (HPLC). In the HPLC method, samples were prepared for analysis by weighing accurately 80 to 120 mg of sample into a 10 ml volumetric flask, diluting to the level mark with methylene chloride, and mixing until the sample is fully dissolved.

The HPLC system used in the HPLC method included a HPLC pump, a thermostatted HPLC column compartment, HPLC fluorescence detector, and PC-based chromatography data acquisition system. The particular system described, is based on an Agilent 1200 HPLC with ChemStation software. The HPLC column was a Phenomenex Luna C8(2) 150×4.6 mm 5 μm 100 Å, P/N 00F4249E0.

The following system settings were used in performing the analyses:

Pump flow=1.0 ml/min

Maximum pressure=200 bars

Fluorescence wavelength: 225 excitation 313 emission: Gain=9

Column Thermostat temperature=25 C

Injection Size=1 μL of diluted sample

Elution type: Gradient, reverse phase

Gradient: 0-7 min 85/15 methanol/water switching to 100% methanol linear gradient.

Run time: 17 minutes

The resulting chromatogram typically contains several peaks. Peaks due to the free unsulfurized alkylhydroxyaromatic compound typically elute together at early retention times; whereas peaks due to sulfurized salts of alkylhydroxyaromatic compounds typically elute at longer retention times. For purposes of quantitation, the area of the single largest peak of the free unsulfurized alkylhydroxyaromatic compound and its unsulfurized metal salt was, measured, and then that area was used to determine the concentration of the total free unsulfurized alkylhydroxyaromatic compound and its unsulfurized metal salt species. The assumption is that the speciation of alkylhydroxyaromatic compounds does not change; if something does change the speciation of the alkylhydroxyaromatic compounds, then recalibration is necessary.

The area of the chosen peak is compared to a calibration curve to arrive at the wt. % of free alkylphenol and free unsulfurized salts of alkylphenols. The calibration curve was developed using the same peak in the chromatogram obtained for the free unsulfurized alkylhydroxyaromatic compound used to make the phenate product.

The following components are used below in formulating a marine diesel engine lubricating oil composition.

ExxonMobil CORE® 600N: Group I-based lubricating oil was ExxonMobil CORE® 600N basestock: available from ExxonMobil (Irving, Tex.).

ExxonMobil CORE® 2500BS: Group I-based lubricating oil was ExxonMobil CORE® 2500BS basestock, available from ExxonMobil (Irving, Tex.).

Comparative Example A

Preparation of Basic Sulfurized Carbonated Calcium Alkyl Phenate

A slurry of an alkylphenol wherein the alkyl radical was derived from a polypropylene having an average of 12 carbon atoms, base oil, fluorine-containing silicon foam inhibitor, and lime are added to a reactor. The slurry was heated to 120° C. and sulfonic acid is added. Sulfur is slowly added to the reactor at about 130° C., and at about 150° C. decyl alcohol and ethylene glycol were added slowly to the reactor which was kept at about 150-155° C. for the entire addition. The reaction mixture was then heated to about 175° C. and another aliquot of ethylene glycol was added while simultaneously sparging $CO_2$. After carbonation, the mixture was heated to about 230° C. and vacuum applied to remove water, ethylene glycol, and decyl alcohol. Additional lube oil was blended in to achieve a diluted detergent additive as characterized below in Table 1:

TABLE 1

| | |
|---|---|
| TBN, mg KOH/g | 263 |
| Vis @ 100° C. (cSt) | 308 |
| Ca (wt %) | 9.63 |
| S (wt %) | 3.21 |
| S/Ca | 0.33 |

Example 1

Variant 1

Preparation of Basic Sulfurized Carbonated Calcium Alkyl Phenate (A) A non-overbased sulfurized alkylphenate detergent concentrate is prepared using a process similar to that of Example 4 of U.S. Pat. No. 5,529,705. The $C_{12}$ alkylphenol of Comparative Example A was reacted with lime and sulfur in the presence of a mixture of formic and acetic acid promoter in the absence of a polyol promoter at a temperature of between 260 and 410° F. using a programmed temperature and raw material addition profile. After filtration to remove unreacted lime, an is then sparged into the reaction mixture at a rate of about 2 to 2.5 Nm of air/hr/$m^3$ of reaction product at 155° C. for about 10 to 12 hours. The final product is a non-overbased sulfurized alkylphenate detergent concentrate substantially free of polyol promoter oxidation products having a TBN of about 120 mg KOH/kg detergent, a calcium content of about 4.25 wt. % and a sulfur content of about 5.5 wt. % resulting in a sulfur to calcium ratio of 1.29.

(B) In a 2000 liter reactor, 699 kg of the reaction product of (A), 136 kg of lube oil 22.7 kg of alkyltoluene sulfonic acid (AS 305BD, an alkylaryl sulfonic acid available from Chevron Oronite Company LLC), 210 kg of isodecyl alcohol, 60 nil of antifoam, and 150 kg of calcium hydroxide were first charged. After approximately 30 minutes of agitation to homogenize the mixture, the mixture was heated to 149° C. over 60 minutes. After reaching 149° C., the temperature was increased further to 177° C. over 60 minutes. During the ramp from 149° C. to 177° C., 87 kg of ethylene glycol was charged at as rate of 1.45 kg per hour such that glycol charging was completed when the temperature reaches 177° C.

Carbon dioxide was sparged into the reaction mixture at a rate of 0.14 kg per minute for a total of 30 minutes. At the same time, a second glycol charge totaling 65.5 kg was metered into the reactor over a period of 60 minutes. A second $CO_2$ charge was started immediately after completion of the first $CO_2$ charge. The second $CO_2$ charge was 55 kg and was metered over a period of 175 minutes.

After completion of the carbonation step, the reactor temperature was increased to 227° C. as fast as possible while simultaneously decreasing reactor pressure to 61) mm Hg or less. The reactor was held at this temperature and pressure for 1 hour. After 1 hour, the reactor contents were sparged with nitrogen for additional hour at 227° C. and approximately 50-100 mm Hg. After completing the distillation step, the erode reaction mixture was cooled to 150 to 170° C. A filter aid was added and the crude product was filtered to remove unreacted lime.

Variant 2

Variant 2 was prepared in substantially the same manner as variant 1 except air was sparged into the filtered product at 150 to 160° C. for a period of 8 hours at atmospheric pressure. Au rate was maintained at 5 standard liters per hour per kg of the product.

Variant 3

Variant 3 was prepared in substantially the same manner as variant 1 except lime charge was increased to 164 kg.

Variant 4

Variant 4 was prepared in substantially the same manner as variant 3, except that the lime charge was increased to 164 kg and reaction product was subjected to the air sparging step described in variant 2.

Variant 5

Variant 5 was prepared as follows: 223 kg, of the product of Example 1A, 18 g foam inhibitor, 66.8 kg 2-ethylhexanol and 24.5 kg 130N base oil were loaded in a 750 L stainless steel reactor at 65° C. Next, 7.3 kg AS 305BD was added to the mixture at 65° C. Then, 43.5 kg hydrated lime was added in the reactor under vigorous agitation. The reactor temperature was increased from 65° C. to 149° C. in 50 min and the pressure was set to 0.95 bar abs. The reactor mixture was warmed up to 170° C. in 1 hour and during the same period, 27.8 kg ethylene glycol was added. Then, 1.4 kg $CO_2$ was added in 30 min and 20.9 kg ethylene glycol in 1 hour.

At the end of the $CO_2$ charge addition, a second $CO_2$ charge of 17.7 kg was added during 2 hours. The reactor pressure was then set to 1 bar abs to allow reactor sampling. The reactor was then put under vacuum (30 mbar) in 1 h at 170° C., and the temperature was increased to 225° C. in 50 mitt and both conditions (225° C./30 mbar) were maintained for 1 h for solvent distillation. The product was cooled down to 170° C. and filtered with Primisil filter aid at 160° C. The filtered product was span-zed with air (22.6 Orlin) at 160° C. during 8 h under mild agitation.

Variant 6

Variant 6 was prepared in substantially the same manner as variants 1-5 except the synthesis was conducted in a 4 liter glass reactor and the sulfur charge was reduced during the preparation of reaction product (A) to lower the sulfur to calcium ratio. 1000 grams of the reaction product of (A) with a sulfur to calcium ratio of 1.13, 110 grams of lube oil, 300 grams of isodecyl alcohol, 195 grams of lime, and 32 grams of alkyltoluene sulfonic acid were charged to the laboratory reactor. The reaction mixture was then heated as fast as possible to 149° C. After reaching 149° C., the reactor temperature was then ramped to 177° C. over 1 hour while simultaneously adding 125 grams of glycol. The glycol was also charged over 1 hour.

After reaching 177° C., 6 grams of $CO_2$ was sparged into the reaction mixture over a period of 30 minutes after which an additional 79 grams of $CO_2$ was charged over a 2 hour period. Following the carbonation step, the reactor temperature was increased to 218° C. while simultaneously reducing the pressure to 40 mm Hg. The reactor was held at the final distillation conditions (218° C. and 40 mm Hg) for 30 minutes. Products were then filtered after the addition of some filter aid. The filtered products were then heat soaked in the same 4 liter reactor for 24 hours at 225° C. with a small nitrogen sweep into the head space above the liquid layer. Oil was then added to adjust calcium to approximately 9.5 wt %.

Variant 7

Variant 7 was also prepared in a laboratory reactor using the charges and procedure described for variant 6. Variant 7, however, used the reaction product of (A) instead of a reaction product of (A) with a substantially lower sulfur to calcium ratio.

The analytical results for variant 1-7 are set forth below in Table 2:

TABLE 2

| | Variant | | | | | | |
|---|---|---|---|---|---|---|---|
| | 1 | 2 | 3 | 4 | 5 | 6 | 7 |
| Ca (wt %) | 9.8 | 9.76 | 10 | 10 | 10.1 | 9.2 | 9.6 |

TABLE 2-continued

| | Variant | | | | | | |
|---|---|---|---|---|---|---|---|
| | 1 | 2 | 3 | 4 | 5 | 6 | 7 |
| Vis @ 100° C. (cSt) | 437 | 486 | 439 | 443 | 951 | 201 | 374 |
| TPP (wt %) | 1.19 | 1.21 | 1.27 | 1.3 | 1.53 | 1.39 | 1.01 |

Comparative Example B and Examples 1a-1e

The following marine diesel engine lubricating oil compositions were prepared using components and amounts as set forth below in Table 3. The additive components and amounts were the same for each of the examples. The TBN of these compositions was maintained at 38.7 to 40.1 mgKOH/g, and the finished oil viscosity was maintained at 19.4 to 20.5 cSt at 100° C. regardless of which overbased detergent was used for the test composition. The marine diesel engine lubricating oil compositions were evaluated using the MIP-48 test.

TABLE 3

| Component Type | Units | Comp. Ex. B | Ex. 1a | Ex. 1b | Ex. 1c | Ex. 1d | Ex. 1e |
|---|---|---|---|---|---|---|---|
| Comp. Ex. A | [m %] | 14.89 | — | — | — | — | — |
| Example 1, variant 1 | [m %] | — | 14.19 | — | — | — | — |
| Example 1, variant 2 | [m %] | — | — | 14.01 | — | — | — |
| Example 1, variant 3 | [m %] | — | — | — | 13.87 | — | — |
| Example 1, variant 4 | [m %] | — | — | — | — | 13.99 | — |
| Example 1, variant 5 | [m %] | — | — | — | — | — | 13.79 |
| Dispersant | [m %] | 1.08 | 1.08 | 1.08 | 1.08 | 1.08 | 1.08 |
| Foam inhibitor | [m %] | 0.10 | 0.10 | 0.10 | 0.10 | 0.10 | 0.10 |
| ExxonMobil CORE ® 600N | [m %] | 53.09 | 52.87 | 52.81 | 52.77 | 52.81 | 52.74 |
| ExxonMobil CORE ® 2500BS | [m %] | 30.84 | 31.76 | 32.00 | 32.18 | 32.02 | 32.29 |
| Total Amount | [m %] | 100.00 | 100.00 | 100.00 | 100.00 | 100.00 | 100.00 |
| TBN | [mgKOH/g] | 40.1 | 39.7 | 39.3 | 39.8 | 40.1 | 38.7 |
| Viscosity (at 100° C.) | [cSt] | 19.42 | 19.86 | 19.89 | 19.99 | 19.96 | 20.51 |
| MIP-48 Test Result, Viscosity Increase | [%] | 46.7 | 29.8 | 29.1 | 22.5 | 23.5 | 29.7 |

Comparative Example C and Examples 2a-2e

The following marine diesel engine lubricating oil compositions were prepared using components and amounts as set forth below in Table 4. The additive components and amounts were the same for each of the examples. The TBN of these compositions was maintained at 30.2 to 30.5 mgKOH/g and the finished oil viscosity was maintained at 14.0 to 14.2 cSt at 100° C. regardless of which overbased detergent was used for the test composition. The marine diesel engine lubricating oil compositions were evaluated using the MIP-48 test.

TABLE 4

| Components | Units | Comp. Ex. C | Ex. 2a | Ex. 2b | Ex. 2c | Ex. 2d | Ex. 2e |
|---|---|---|---|---|---|---|---|
| Comp. Ex. A | [m %] | 3.64 | — | — | — | — | — |
| Example 1, variant 1 | [m %] | — | 3.47 | — | — | — | — |

TABLE 4-continued

| Components | Units | Comp. Ex. C | Ex. 2a | Ex. 2b | Ex. 2c | Ex. 2d | Ex. 2e |
|---|---|---|---|---|---|---|---|
| Example 1, variant 2 | [m %] | — | — | 3.42 | — | — | — |
| Example 1, variant 3 | [m %] | — | — | — | 3.39 | — | — |
| Example 1, variant 4 | [m %] | — | — | — | — | 3.42 | — |
| Example 1, variant 5 | [m %] | — | — | — | — | — | 3.37 |
| Other Additives | | | | | | | |
| Detergent(s) | [m %] | 8.36 | 8.36 | 8.36 | 8.36 | 8.36 | 8.36 |
| Antiwear Agent | [m %] | 0.52 | 0.52 | 0.52 | 0.52 | 0.52 | 0.52 |
| Foam Inhibitor | [m %] | 0.03 | 0.03 | 0.03 | 0.03 | 0.03 | 0.03 |
| ExxonMobil CORE ® 600N | [m %] | 84.15 | 84.10 | 84.08 | 84.07 | 84.08 | 84.07 |
| ExxonMobil CORE ® 2500BS | [m %] | 3.30 | 3.52 | 3.59 | 3.63 | 3.59 | 3.65 |
| Total Amount | [m %] | 100.00 | 100.00 | 100.00 | 100.00 | 100.00 | 100.00 |
| TBN | [mgKOH/g] | 30.4 | 30.5 | 30.4 | 30.5 | 30.3 | 30.2 |
| Viscosity (at 100° C.) | [cSt] | 14.01 | 14.06 | 14.00 | 14.06 | 14.06 | 14.17 |
| MIP-48 Test Result, Viscosity Increase | [%] | 25.3 | 20.1 | 15.6 | 16.0 | 17.7 | 16.1 |

Comparative Example D and Examples 3a-3e

The following marine diesel engine lubricating oil compositions were prepared using same components and amounts as set forth below in Table 5. The additive components and amounts were the same for each of the examples. The TBN of these compositions was maintained at 69.6 to 70.5 mg KOH/g and the finished oil viscosity was maintained at 20.0 to 20.6 cSt at 300° C. regardless of which overbased detergent was used for the test composition. The marine diesel engine lubricating oil compositions were evaluated using the MIP-48 test.

TABLE 5

| Components | Units | Comp. Ex. D | Ex. 3a | Ex. 3b | Ex. 3c | Ex. 3d | Ex. 3e |
|---|---|---|---|---|---|---|---|
| Comp. Ex. A | [m %] | 9.30 | — | — | — | — | — |
| Example 1, variant 1 | [m %] | — | 8.86 | — | — | — | — |
| Example 1, variant 2 | [m %] | — | — | 8.75 | — | — | — |
| Example 1, variant 3 | [m %] | — | — | — | 8.66 | — | — |
| Example 1, variant 4 | [m %] | — | — | — | — | 8.74 | — |
| Example 1, variant 5 | [m %] | — | — | — | — | — | 8.61 |
| Other Additives | | | | | | | |
| Detergent(s) | [m %] | 10.74 | 10.74 | 10.74 | 10.74 | 10.74 | 10.74 |
| Dispersant | [m %] | 1.50 | 1.50 | 1.50 | 1.50 | 1.50 | 1.50 |
| Foam inhibitor | [m %] | 0.04 | 0.04 | 0.04 | 0.04 | 0.04 | 0.04 |
| ExxonMobil CORE ® 600N | [m %] | 54.49 | 54.35 | 54.31 | 54.28 | 54.31 | 54.27 |
| ExxonMobil CORE ® 2500BS | [m %] | 23.93 | 24.51 | 24.66 | 24.78 | 24.67 | 24.84 |
| Total Amount | [m %] | 100.00 | 100.00 | 100.00 | 100.00 | 100.00 | 100.00 |
| TBN | [mgKOH/g] | 70.2 | 70.5 | 69.8 | 70.4 | 70.2 | 69.6 |
| Viscosity (at 100° C.) | [cSt] | 20.00 | 20.08 | 20.05 | 20.09 | 20.15 | 20.60 |
| MIP-48 Test Result, Viscosity Increase | [%] | 38.1 | 22.8 | 24.2 | 27.6 | 21.9 | 19.6 |

Comparative Example E and Examples 4a-4-b

The following marine diesel engine lubricating oil compositions were prepared using, components and amounts as set forth below in Table 6. The additive components and amounts were the same for each of the examples. The TBN of these compositions was maintained at 68.4 to 68.9 mg KOH/g and the finished oil viscosity was maintained at 19.9 to 20.2 cSt at 100° C. regardless of which overbased detergent was used for the test composition. The marine diesel engine lubricating, oil compositions were evaluated using the MIP-48 test.

TABLE 6

| Components | Units | Comp. Ex. D | Ex. 4a | Ex. 4b |
|---|---|---|---|---|
| Comp. Ex. A | [m %] | 9.30 | — | — |
| Example 1, variant 6 | [m %] | — | 9.40 | — |
| Example 1, variant 7 | [m %] | — | — | 9.20 |

TABLE 6-continued

| Components | Units | Comp. Ex. D | Ex. 4a | Ex. 4b |
|---|---|---|---|---|
| Other Additives | | | | |
| Detergent(s) | [m %] | 10.70 | 10.70 | 10.70 |
| Dispersant | [m %] | 1.50 | 1.50 | 1.50 |
| Foam inhibitor | [m %] | 0.04 | 0.04 | 0.04 |

TABLE 6-continued

| Components | Units | Comp. Ex. D | Ex. 4a | Ex. 4b |
|---|---|---|---|---|
| ExxonMobil CORE ® 600N | [m %] | 54.48 | 54.51 | 54.45 |
| ExxonMobil CORE ® 2500BS | [m %] | 23.98 | 23.85 | 24.11 |
| Total Amount | [m %] | 100.00 | 100.00 | 100.00 |
| TBN | [mgKOH/g] | 68.6 | 68.4 | 68.9 |
| Viscosity (at 100° C.) | [cSt] | 20.03 | 19.90 | 20.24 |
| MIP-48 Test Result, Viscosity Increase | [%] | 26.5 | 12.8 | 10.4 |

Comparative Example E-J

The following marine diesel engine lubricating oil compositions were prepared using the same components and amounts as set forth below in Table 7. The additive components and amounts were the same for each of the examples. The TBN of these compositions was maintained at 9.3 to 9.5 mg KOH/g and the finished oil viscosity was maintained at 14.39 to 14.48 cSt at 100° C. regardless of which overbased detergent was used for the test composition. The marine diesel engine lubricating oil compositions were evaluated using the MIP-48 test.

TABLE 7

| Components | Units | Comp. Ex. E | Comp. Ex. F | Comp. Ex. G | Comp. Ex. H | Comp. Ex. I | Comp. Ex. J |
|---|---|---|---|---|---|---|---|
| Comp. Ex. A | [m %] | 1.74 | — | — | — | — | — |
| Example 1, variant 1 | [m %] | — | 1.66 | — | — | — | — |
| Example 1, variant 2 | [m %] | — | — | 1.64 | — | — | — |
| Example 1, variant 3 | [m %] | — | — | — | 1.62 | — | — |
| Example 1, variant 4 | [m %] | — | — | — | — | 1.63 | — |
| Example 1, variant 5 | [m %] | — | — | — | — | — | 1.61 |
| Other Additives | | | | | | | |
| Detergent(s) | [m %] | 2.13 | 2.13 | 2.13 | 2.13 | 2.13 | 2.13 |
| Dispersant | [m %] | 0.87 | 0.87 | 0.87 | 0.87 | 0.87 | 0.87 |
| Foam inhibitor | [m %] | 0.03 | 0.03 | 0.03 | 0.03 | 0.03 | 0.03 |
| ExxonMobil CORE ® 600N | [m %] | 80.66 | 80.63 | 80.63 | 80.62 | 80.62 | 80.62 |
| ExxonMobil CORE ® 2500BS | [m %] | 14.57 | 14.68 | 14.70 | 14.73 | 14.72 | 14.74 |
| Total Amount | [m %] | 100.00 | 100.00 | 100.00 | 100.00 | 100.00 | 100.00 |
| TBN | [mgKOH/g] | 9.5 | 9.3 | 9.4 | 9.3 | 9.3 | 9.3 |
| Viscosity (at 100° C.) | [cSt] | 14.39 | 14.43 | 14.44 | 14.45 | 14.46 | 14.48 |
| MIP-48 Test Result, Viscosity Increase | [%] | 57.1 | 61.5 | 56.6 | 60.7 | 58.2 | 58.2 |

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A marine diesel engine lubricating oil composition which comprises (a) a major amount of an oil of lubricating viscosity, and (b) about 3 wt. % to 14.19 wt. %, based on the total weight of the marine diesel engine lubricating oil composition, of a sulfurized, alkaline earth metal alkylphenate detergent which is substantially free of polyol promoter oxidation products, the sulfurized, alkaline earth metal alkylphenate detergent being prepared by a process comprising (i) contacting an alkylphenol having at least one alkyl substituent from 6 to 36 carbon atoms with sulfur, in the presence of a promoter acid selected from the group of alkanoic acids having 1 through 3 carbon atoms, mixtures of the alkanoic acids, alkaline earth metal salts of the alkanoic acids and mixtures thereof, and at least a stoichiometric amount of a calcium base sufficient to neutralize the alkylphenol and the promoter at a temperature of from about 130° C. to about 250° C. under reactive conditions in the absence of at polyol promoter or an alkanol having 1 to 5 carbon atoms for a sufficient period of time to react essentially all of the sulfur thereby yielding a calcium sulfurized alkylphenate essentially free of elemental sulfur; and (ii) contacting the reaction product of step (i) with carbon dioxide and additional calcium base, if required, to provide the desired TBN, in the presence of an alkylene glycol having 2 to 6 carbon atoms under reactive conditions at a temperature of from about 150° C. to about 260° C., wherein the marine diesel engine lubricating oil composition has a total base number (TBN) of from about 30 to about 70.

2. The marine diesel engine lubricating oil composition of claim 1, having a TBN of from about 40 to about 70.

3. The marine diesel engine lubricating oil composition of claim 1, having a kinematic viscosity at 100° C. of from about 12.5 to about 26.1 centistokes (cSt).

4. The marine diesel engine lubricating oil composition of claim 1, further comprising one or more alkaline earth metal sulfonates.

5. The marine diesel engine lubricating oil composition of claim 4, wherein the one or more alkaline earth metal sulfonates are alkaline earth metal alkylaromatic sulfonates.

6. The marine diesel engine lubricating oil composition of claim 5, wherein the one or more alkaline earth metal alkylaromatic sulfonates are low overbased alkaline earth metal alkylaromatic sulfonates.

7. The marine diesel engine lubricating oil composition of claim 5, wherein the one or more alkaline earth metal alkylaromatic sulfonates are high overbased alkaline earth metal alkylaromatic sulfonates.

8. The marine diesel engine lubricating oil composition of claim 1, further comprising one or more alkali or alkaline earth metal salts of an alkyl-substituted hydroxyaromatic carboxylic acid.

9. The marine diesel engine lubricating oil composition of claim 1, further comprising a marine diesel engine lubricating oil composition additive selected from the group consisting of an antioxidant, ashless dispersant, detergent, rust inhibitor, dehazing agent, demulsifying agent, metal deactivating agent, friction modifier, pour point depressant, antifoaming agent, co-solvent, package compatibiliser, corrosion-inhibitor, dyes, extreme pressure agent and mixtures thereof.

10. A method for improving oxidative stability of a marine diesel engine lubricating oil composition used in a marine diesel engine, the method comprising adding about 3 wt. % to 14.19 wt. %, based on the total weight of the marine diesel engine lubricating oil composition, of a sulfurized, alkaline earth metal alkylphenate detergent which is substantially free of polyol promoter oxidation products to a marine diesel engine lubricating oil composition comprising a major amount of an oil of lubricating viscosity to form a marine diesel engine lubricating oil composition having a TBN of from about 30 to about 70, wherein the sulfurized, alkaline earth metal alkylphenate detergent is prepared by a process comprising (i) contacting an alkylphenol having at least one alkyl substituent from 6 to 36 carbon atoms with sulfur, in the presence of a promoter acid selected from the group of alkanoic acids having 1 through 3 carbon atoms, mixtures of the alkanoic acids, alkaline earth metal salts of the alkanoic acids and mixtures thereof, and at least a stoichiometric amount of a calcium base sufficient to neutralize the alkylphenol and the promoter at a temperature of from about 130° C. to about 250° C. under reactive conditions in the absence of a polyol promoter or an alkanol having 1 to S carbon atoms for a sufficient period of time to react essentially all of the sulfur thereby yielding a calcium sulfurized alkylphenate essentially free of elemental sulfur; and (ii) contacting the reaction product of step (i) with carbon dioxide and additional calcium base, if required, to provide the desired TBN, in the presence of an alkylene glycol having 2 to 6 carbon atoms under reactive conditions at a temperature of from about 150° C. to about 260° C.

11. The method of claim 10, wherein the marine diesel engine lubricating oil composition has a TBN of from about 40 to about 70.

12. The method of claim 10, wherein the marine diesel engine lubricating oil composition has a kinematic viscosity at 100° C. of from about 12.5 to about 26.1 cSt.

13. The method of claim 10, wherein the marine diesel engine lubricating oil composition further comprises one or more alkaline earth metal sulfonates.

14. The method of claim 13, wherein the one or more alkaline earth metal sulfonates are alkaline earth metal alkylaromatic sulfonates.

15. The method of claim 10, wherein the marine diesel engine lubricating oil composition further comprises one or more alkali or alkaline earth metal salts of an alkyl-substituted hydroxyaromatic carboxylic acid.

16. The method of claim 10, wherein the marine diesel engine lubricating oil composition further comprises a marine diesel engine lubricating oil composition additive selected from the group consisting of an antioxidant, ashless dispersant, detergent, rust inhibitor, dehazing agent, demulsifying agent, metal deactivating agent, friction modifier, pour point depressant, antifoaming agent, co-solvent, package compatibiliser, corrosion-inhibitor, dyes, extreme pressure agent and mixtures thereof.

* * * * *